US012571072B2

(12) United States Patent
Kovalenko

(10) Patent No.: US 12,571,072 B2
(45) Date of Patent: Mar. 10, 2026

(54) METHOD FOR THE PRODUCTION OF A SMALL-FRACTION TITANIUM-CONTAINING FILLING FOR A CORED WIRE

(71) Applicant: Pylyp Kovalenko, Zaporizhzhia (UA)

(72) Inventor: Pylyp Kovalenko, Zaporizhzhia (UA)

( * ) Notice: Subject to any disclaimer, the term of this patent is extended or adjusted under 35 U.S.C. 154(b) by 477 days.

(21) Appl. No.: 18/130,090

(22) Filed: Apr. 3, 2023

(65) Prior Publication Data

US 2024/0117469 A1 Apr. 11, 2024

(51) Int. Cl.

| | |
|---|---|
| ***C22C 1/04*** | (2023.01) |
| ***B22F 1/05*** | (2022.01) |
| ***B22F 9/04*** | (2006.01) |
| ***C22C 14/00*** | (2006.01) |

(52) U.S. Cl.

CPC ..... *C22C 1/0458* (2013.01); *B22F 1/05* (2022.01); *B22F 9/04* (2013.01); *C22C 14/00* (2013.01); *B22F 2301/205* (2013.01); *B22F 2301/35* (2013.01); *B22F 2304/15* (2013.01); *B22F 2998/10* (2013.01); *B22F 2999/00* (2013.01)

(58) Field of Classification Search

CPC ..... C22C 1/0458

See application file for complete search history.

(56) References Cited

U.S. PATENT DOCUMENTS

| | | | | |
|---|---|---|---|---|
| 7,897,103 | B2 * | 3/2011 | Ott | B23K 35/40 148/513 |
| 2013/0071284 | A1 * | 3/2013 | Kano | B22F 1/09 75/343 |
| 2014/0334964 | A1 * | 11/2014 | Kanou | B22F 3/20 419/48 |

OTHER PUBLICATIONS

Chae, Jikwang, et al. "Eco-friendly pretreatment of titanium turning scraps and subsequent preparation of ferro-titanium ingots." Korean Journal of Metals and Materials 57.9 (2019): 569-574.*

* cited by examiner

*Primary Examiner* — Christopher S Kessler
(74) *Attorney, Agent, or Firm* — Nadya Reingand

(57) ABSTRACT

The present invention relates to metallurgy and, more particularly, to a method for the production of a blend for a small-fraction titanium-containing filling for a cored wire. The method uses at least one titanium-containing component, and at least one iron-containing component, wherein an iron-containing diluting component or an iron-containing diluting component together with a titanium-containing enriching component is added to a basic titanium-containing component, said components are mixed to achieve a homogeneous blend.

6 Claims, No Drawings

METHOD FOR THE PRODUCTION OF A SMALL-FRACTION TITANIUM-CONTAINING FILLING FOR A CORED WIRE

FIELD OF INVENTION

The present invention relates to metallurgy and, more particularly, to a method (process) for the production of a blend for a small-fraction titanium-containing filling for a cored wire enabling the use of said blend as a substitute for small-fraction ferrotitanium, which is used in the steelmaking industry as a filling for a cored wire for the purpose of deoxidation and/or alloying (micro-alloying) of steel, i.e. as an addition alloy.

BACKGROUND

The application of cored wires has been employed in the steelmaking industry for over 40 years. The technology of injection of cored wire into liquid steel has proven to be a matured technology for improving (modifying) quality of steel according to target requirements, and it has many other advantages compared to older steel treatment technologies. Cored wire is a metal pipe made of low-carbon steel filled with powder. Cored wire diameter varies depending on the specification of a cored wire feeding machine (feeder), but it is usually 13 mm Cored wire is fed to a ladle, filled with liquid steel, using said machine configured to adjust the feeding speed to match particular requirements enabling precise control of the liquid steel composition and steel parameters. The powder contained in the cored wire disperses and reacts with the liquid steel. The examples of the uses of the above process are micro-alloying, processability improvement, desulfurization, deoxidation, etc. The classification of cored wire is based on the chemical composition of powder contained therein. There are the following types of cored wires: calcium, silico-calcium, carbon, sulfur, ferrotitanium, etc. The use of the cored wire feeding system has a lot of advantages, including increasing the output of steel, lowering steel production costs, having less of a negative impact on the environment, providing more precise control over the materials being added and the target quality of steel, decreasing the energy consumption, and decreasing the amount of slag formed. Cored wires have become an essential part of the steelmaking industry.

It is known in the prior art that the above-mentioned small-fraction ferrotitanium, which is used as a cored wire filling, is obtained by crushing and milling lumpy ferrotitanium (patent No. RU2364633C1; published on 20 Aug. 2009). This means that every single particle of the filling has a chemical composition of ferrotitanium. Considering the existing technological processes and requirements for steel production, steelmakers use cored wires filled with the small-fractioned ferrotitanium (with particle sizes not to exceed 2 mm) comprising a certain range of content of chemical elements. Said certain range of the element content in the chemical composition is configured to avoid the need for any additional calculations or for any changes to the ordinary continuous technological process of the liquid steel treatment.

Said ferrotitanium, which is used as a cored wire filling, is in the form of particles with a maximum size of 2 mm and chemical composition comprising:

Ti content within a range of 68% to 72% inclusive, and Fe content and at least one of the following impurities: Al not to exceed 5%, V not to exceed 3%, C not to exceed 0.3%, Si not to exceed 0.5%, P not to exceed 0.04%, S not to exceed 0.04%, N2 not to exceed 0.5%, O2 not to exceed 2%, Bi not to exceed 0.01%, Pb not to exceed 0.03%, Mn not to exceed 1%, Sn not to exceed 1.5%, or another impurity.

In the description of the patent of the People's Republic of China No. CN100425718C (IPC: C22C 14/00, C22C 1/03, C22C 33/04, C22C 38/14; publ. 15 Oct. 2008) a method is disclosed for the production of a small-fraction ferrotitanium filling for a cored wire. Said method focuses on obtaining ferrotitanium with a low nitrogen content. The product produced under said method has a general chemical composition comprising a content of titanium within a range of 60% to 80% inclusive, nitrogen not to exceed 0.15%, aluminum not to exceed 0.75%, silicon not to exceed 0.5%, carbon not to exceed 0.1%, phosphorus not to exceed 0.04%, sulfur not to exceed 0.03%, and the rest is iron. Said method involves the use of a metallurgical furnace and heating the raw materials to the melting temperature or another high temperature close to the melting temperature of the raw materials. High-quality steel scrap or pure iron, titanium sponge, and titanium waste are used as initial raw materials in said method. Said initial raw materials must have a low content of nitrogen, aluminum, silicon, carbon, phosphorus, and sulfur impurities. A steel melting furnace with a special magnesite or clinker lining with a low nitrogen and aluminum content (not to exceed 0.15% and 0.75%, respectively) is used to melt the raw materials. High-quality steel scrap or pure iron is fed into the furnace on a one-off basis, whereafter titanium sponge and titanium waste are added. Content of the steel scrap or pure iron ranges from 25% to 29% inclusive (in a particular embodiment the content is 27%), content of the titanium sponge ranges from 28% to 32% inclusive (in the particular embodiment the content is 30%), and content of the titanium waste ranges from 41% to 45% inclusive (in the particular embodiment the content is 43%). During the melting process, industrial salt is added to the furnace, enabling formation of slag and removal of harmful polluting impurities, including carbon. Argon is used during the melting process in order to remove nitrogen and oxygen. The obtained melted metal is poured into a mold, and after solidification and cooling, the resulting hard alloy of ferrotitanium is crushed into pieces, and milled down into powder with fraction size less than or equal to 2 mm using a plurality of special crushing devices.

However, the method of production described has many disadvantages, including considerable energy intensity, emission of environmentally harmful CO2 and slag due to the use of a metallurgical furnace, and heating of the raw materials to the melting temperature or another high temperature close to the melting temperature of the raw materials. The necessary crushing and milling of ferrotitanium also involves additional energy consumption. Additional costs are also associated with the use of special lining for the steel melting furnace, as well as the use of industrial salt and argon.

As already mentioned above, steel manufacturers use cored wires filled with small-fraction ferrotitanium with a certain range of content of chemical elements. Said certain content of elements in a chemical composition is configured to avoid the need for any additional calculations or for any changes to the ordinary continuous technological process of liquid steel treatment. Said content of chemical elements comprises a titanium content ranging from 68% to 72% inclusive. Instead, the method described above is configured to obtain ferrotitanium with a titanium content ranging from 60% to 80% inclusive, which significantly limits the applicability of such a product because of a wider range of titanium therein.

As mentioned earlier, the content of elements in a chemical composition of a small-fraction ferrotitanium filling for cored wires, which are used by steelmakers, requires a mandatory limitation of content of such harmful elements as vanadium (not to exceed 3%), oxygen (not to exceed 2%), bismuth (not to exceed 0.01%), lead (not to exceed 0.03%), manganese (not to exceed 1%), and tin (not to exceed 1.5%). However, the above-described method for the production of a small-fraction ferrotitanium filling for a cored wire neither determines nor limits the content of said harmful impurities that may be present in the above-described raw materials, thus significantly limiting or even hampering the application of said method.

Besides, the method described above does not disclose the processes of regulation of the titanium content mentioned therein or the content of harmful impurities such as nitrogen, aluminum, silicon, carbon, phosphorus, and sulfur. At the same time, said method sets forth a limiting condition on content of the components in the initial raw materials: steel scrap or pure iron in a range of 25% to 29% inclusive, titanium sponge in a range of 28% to 32% inclusive, titanium waste in a range of 41% to 45% inclusive.

Moreover, occupational safety at a metallurgical production facility is very important as the operation of a metallurgical furnace and high temperatures are generally a risk factor for human health.

SUMMARY

The object of the present invention is creation of a method for the production of a small-fraction titanium-containing filling for a cored wire configured to avoid the use of metallurgical processing and high temperatures in the production process. More specifically, the object of the present invention is the creation of a method that, in contrast to the production of small-fraction ferrotitanium, neither involves the use of a metallurgical furnace nor the heating of raw materials to the melting temperature or another high temperature close to the melting temperature, and that ensures there is a significant reduction in energy consumption, along with cheaper production of the product, while significantly reducing the negative impact on the environment, and eliminating health and safety risks inherent in metallurgical production.

Based on the aforementioned, the closest prior art of the present invention is the above-described method of production of small-fraction ferrotitanium for a cored wire disclosed in the patent of the People's Republic of China CN100425718C.

The common essential features of the claimed method for the production of a small-fraction titanium-containing filling for a cored wire and the closest prior art are as follows: the use of at least one titanium-containing component and at least one iron-containing component.

The above object is achieved by the use of a method for the production of a small-fraction titanium-containing filling for a cored wire, the method comprising the use of at least one titanium-containing component, and at least one iron-containing component, wherein an iron-containing diluting component or an iron-containing diluting component together with a titanium-containing enriching component is added to a basic titanium-containing component, said components are mixed to achieve a homogeneous blend.

Said mixing of said components is carried out, based on the general chemical composition of each component, in the proportion that enables the resulting general chemical composition of the blend to comprise:

Ti content within a range of 68% to 72% inclusive, and

Fe content and at least one of the following impurities: Al not to exceed 5%, V not to exceed 3%, C not to exceed 0.3%, Si not to exceed 0.5%, P not to exceed 0.04%, S not to exceed 0.04%, N2 not to exceed 0.5%, O2 not to exceed 2%, Bi not to exceed 0.01%, Pb not to exceed 0.03%, Mn not to exceed 1%, Sn not to exceed 1.5%, or another impurity.

Said basic titanium-containing component is production waste and/or product scrap from titanium-based alloys having a general chemical composition that comprises:

Ti content ranging from 50% to 99% inclusive, and at least one of the following impurities: Al not to exceed 50%, V not to exceed 10%, C not to exceed 1%, Si not to exceed 1%, P not to exceed 1%, S not to exceed 1%, N2 not to exceed 1%, O2 not to exceed 3%, Bi not to exceed 1%, Pb not to exceed 1%, Mn not to exceed 1%, Sn not to exceed 2%, or another impurity.

Said iron-containing diluting component is production waste and/or product scrap and/or products from iron-based alloys having a general chemical composition that comprises:

predominant content of Fe, and at least one of the following impurities: Al not to exceed 1%, V not to exceed 1%, C not to exceed 0.2%, Si not to exceed 1%, P not to exceed 1%, S not to exceed 1%, N2 not to exceed 1%, O2 not to exceed 1%, Bi not to exceed 1%, Pb not to exceed 1%, Mn not to exceed 1%, Sn not to exceed 1%, or another impurity.

Said titanium-containing enriching component is a titanium sponge, and/or titanium 3D printing powder or waste thereof, and/or technically pure production waste, and/or product scrap from titanium-based alloy products with high content of titanium.

Said titanium sponge has a general chemical composition that comprises:

Ti content of at least 97%, and at least one of the following impurities: V not to exceed 1%, C not to exceed 0.1%, Si not to exceed 1%, P not to exceed 1%, S not to exceed 1%, N2 not to exceed 1%, O2 not to exceed 2%, Bi not to exceed 1%, Pb not to exceed 1%, Mn not to exceed 1%, or another impurity.

Said titanium 3D printing powder or waste thereof have a general chemical composition that comprises:

Ti content of at least 97%, and at least one of the following impurities: C not to exceed 0.3%, P not to exceed 1%, S not to exceed 1%, N2 not to exceed 1%, O2 not to exceed 2%, Bi not to exceed 1%, Pb not to exceed 1%, Mn not to exceed 1%, or another impurity.

Said technically pure production waste, and/or product scrap from titanium-based alloy products with high content of titanium have a general chemical composition that comprises:

Ti content of at least 92%, and at least one of the following impurities: Al not to exceed 5%, V not to exceed 3%, C not to exceed 0.3%, Si not to exceed 0.5%, P not to exceed 0.04%, S not to exceed 0.04%, N2 not to exceed 0.5%, O2 not to exceed 2%, Bi not to exceed 0.01%, Pb not to exceed 0.03%, Mn not to exceed 1%, Sn not to exceed 1.5%, or another impurity.

All of the above-mentioned components are used in the form of particles with a maximum size of 2 mm, said basic titanium-containing component is pre-washed and/or dried before use.

In some embodiments of the claimed method, said basic titanium-containing component may be production waste and/or product scrap from titanium-based alloys having a general chemical composition that comprises:

Ti content of at least 82%, and at least one of the following impurities: Al not to exceed 6%, V not to exceed 4%, C not to exceed 0.2%, Si not to exceed 0.25%, P not to exceed 0.01%, S not to exceed 0.01%, N2 not to exceed 1%, O2 not to exceed 3%, Bi not to exceed 0.004%, Pb not to exceed 0.001%, Mn not to exceed 0.04%, Sn not to exceed 0.35%, or another impurity.

In some other embodiments, said basic titanium-containing component may be production waste and/or product scrap from titanium-based alloys having a general chemical composition that comprises:

Ti content of at least 99%, and at least one of the following impurities: C not to exceed 0.2%, P not to exceed 0.01%, S not to exceed 0.01%, Bi not to exceed 0.004%, Pb not to exceed 0.001%, Mn not to exceed 0.04%, Sn not to exceed 0.35%, or another impurity.

In some other embodiments, said components in the form of particles may be obtained by sieving.

In some other embodiments, the iron-containing diluting component may be production waste and/or product scrap and/or products from iron-based alloys in the form of swarf, and/or grit, and/or turnings, and/or cuttings, and/or fragments, and/or granules.

In some other embodiments, the titanium-containing enriching component may be technically pure production waste and/or product scrap from titanium-based alloys with high content of titanium in the form of swarf, and/or grit, and/or turnings, and/or cuttings, and/or fragments.

DETAILED DESCRIPTION OF THE PREFERRED EMBODIMENTS

Below is a detailed description of the cause-and-effect relationship between the set of features of the claimed method for the production of a small-fraction titanium-containing filling for a cored wire and the technical result. Given that the present invention can be modified and have alternative variants of embodiments, it is understood that the description detailed below is exemplary of its essential features and implementation. It is further understood that the description detailed below is not to be construed as limiting the present invention to certain embodiments. Instead it includes any modifications, equivalents or alternatives that do not diverge from the spirit and scope of patent protection of the claimed method for the production of a small-fraction titanium-containing filling for a cored wire.

Ferrotitanium, used as a filling for cored wires, performs as an alloying composition, the effectiveness of which depends directly on the chemical composition of said ferrotitanium. Therefore, the idea underlying the claimed method for the production of a small-fraction titanium-containing filling for a cored wire is to obtain a novel filling with the same general chemical composition as that of ferrotitanium. As already mentioned above, said filling, similarly to ferrotitanium, should include a Ti content ranging from 68% to 72%. It should be noted that Fe content in the ferrotitanium filling for cored wires is not specified because it is a neutral element, and only the content of titanium and the limitation of possible harmful impurities are important. For economic reasons, ferrotitanium, rather than titanium, is used as a filling in the cored wires known from the art. The production of a novel titanium-containing filling should be carried out taking into account the previously determined range of content of elements in the chemical composition in order to avoid any further additional calculations and any need to change the ordinary continuous technological process of the steel treatment where the alloying composition is added. Therefore, it is important to have a Ti content in a range of 68% to 72% and to limit the content of the following harmful impurities (each of which may or may not be present): Al not to exceed 5%, V not to exceed 3%, C not to exceed 0.3%, Si not to exceed 0.5%, P not to exceed 0.04%, S not to exceed 0.04%, N2 not to exceed 0.5%, O2 not to exceed 2%, Bi not to exceed 0.01%, Pb not to exceed 0.03%, Mn n not to exceed 1%, Sn not to exceed 1.5%. The presence or content of any other possible impurities in this case is not important.

In the description of the closest prior art above, it was mentioned that the following titanium-containing and iron-containing components are used in the production of ferrotitanium: titanium sponge and titanium waste, high-quality steel scrap or pure iron. The titanium sponge is used in a range of 28% to 32%, and titanium waste is used in a range of 41% to 45%.

The main idea of the claimed invention is to obtain not a ferrotitanium alloy, but a blend of particles of various chemical composition, which together, in terms of their general chemical composition, correspond to the chemical composition of ferrotitanium used in cored wires. Moreover, the claimed method for obtaining said blend is configured to ensure maximum waste disposal and minimization of the use of products or waste with a high titanium content.

Based on the analysis of contents of chemical elements in titanium-based alloy production waste and product scrap of all available grades (cleaned of impurities), the inventor found that all of them comprise a Ti content in a range of 50% to 99% inclusive, and impurities. Said impurities may also comprise the above-mentioned harmful impurities, namely: Al not to exceed 50%, V not to exceed 10%, C not to exceed 1%, Si not to exceed 1%, P not to exceed 1%, S not to exceed 1%, N2 not to exceed 1%, O2 not to exceed 3%, Bi not to exceed 1%, Pb not to exceed 1%, Mn not to exceed 1%, Sn not to exceed 2%. That is, said harmful impurities may or may not be present, and if any are present their content must not exceed said limits.

An important step in the claimed invention is the use of the iron-containing component in the blend exclusively for the purpose of dilution, i.e. as a diluting component, to reduce the content of the harmful impurities stated above and, only where necessary, to reduce content of titanium to the above-described limits of its content in ferrotitanium, i.e. to 72%. Also, only in cases where the raw material has a low content of titanium, or where the use of the diluting iron-containing component leads to a reduction in the titanium content to below 68%, a titanium-containing enriching component is used in the form of a titanium sponge, titanium 3D printing powder or waste thereof, technically pure production waste or product scrap from titanium-based alloy products with a high content of titanium (at least 92%).

Therefore, in the claimed method for the production of a small-fraction titanium-containing filling for a cored wire, said iron-containing diluting component is production waste or product scrap or products from iron-based alloys having a general chemical composition that comprises:

predominant content of Fe, and impurities content that may comprise content of Al not to exceed 1%, V not to exceed 1%, C not to exceed 0.2%, Si not to exceed 1%, P not to exceed 1%, S not to exceed 1%, N2 not to exceed 1%, O2 not to exceed 1%, Bi not to exceed 1%, Pb not to exceed 1%, Mn not to exceed 1%, Sn not to exceed 1%, or other chemical elements. I.e., said harmful impurities may or may not be present, and if any, their content must not exceed said limits Low-carbon steel alloys may be preferable in this case.

In order to be used as an expedient titanium-containing enriching component, said technically pure production waste and/or product scrap from titanium-based alloy products with high content of titanium must have a general chemical composition that comprises:

Ti content of at least 92%, and impurities content that may comprise content of Al not to exceed 5%, V not to exceed 3%, C not to exceed 0.3%, Si not to exceed 0.5%, P not to exceed 0.04%, S not to exceed 0.04%, N2 not to exceed 0.5%, O2 not to exceed 2%, Bi not to exceed 0.01%, Pb not to exceed 0.03%, Mn not to exceed 1%, Sn not to exceed 1.5%, or other chemical elements. That is, said harmful impurities may or may not be present, and if any, their content must not exceed said limits.

Based on the analysis of contents of chemical elements in all available types of titanium sponge, the inventor found that all of them have a chemical composition that comprises:

Ti content of at least 97%, and content of impurities, which may include Al content not more than 3%, V not more than 1%, C not more than 0.1%, Si not more than 1%, P not more than 1%, S not more than 1%, N2 not more than 1%, O2 not more than 2%, Bi not more than 1%, Pb not more than 1%, Mn not more than 1%, Sn not more than 3%, or other chemical elements. That is, said harmful impurities may or may not be present, and if any, their content must not exceed said limits Therefore, the inventor decided to use said titanium sponge in the claimed method as an expedient titanium-containing enriching component.

Based on the analysis of contents of chemical elements in all available types of titanium 3D printing powder or waste thereof, the inventor found that all of them have a chemical composition that comprises:

Ti content of at least 97%, and content of impurities, which may include Al not to exceed 3%, V not to exceed 3%, C not to exceed 0.3%, Si not to exceed 3%, P not to exceed 1%, S not to exceed 1%, N2 not to exceed 1%, O2 not to exceed 2%, Bi not to exceed 1%, Pb not to exceed 1%, Mn not to exceed 1%, Sn not to exceed 3%, or other chemical elements. That is, said harmful impurities may or may not be present, and if any, their content must not exceed said limits. Therefore, the inventor decided to use said titanium 3D printing powder or waste thereof in the claimed method as an expedient titanium-containing enriching component.

The method for the production of a small-fraction titanium-containing filling for a cored wire may be carried out as described below.

As already mentioned, according to the claimed invention, the iron-containing diluting component or the iron-containing diluting component together with the titanium-containing enriching component is added to the basic titanium-containing component, and the said components are mixed to achieve a homogeneous composition.

The basic titanium-containing component is production waste from titanium-based alloys or product scrap from titanium-based alloys, which may be in the form of swarf, grit, cuttings, fragments, or small products. It is obvious that such raw materials may be contaminated with grease and/or lubricants. Said contaminants may be water-based or oil-based, and may be of various chemical compositions. Said titanium-containing raw materials are mainly collected at scrapyards or by processors, where the materials are usually mixed with each other during their loading, unloading and storage, so it is difficult to subsequently separate them by the type of lubricant with which they are contaminated. Therefore, prior to use of the basic titanium-containing component, it must undergo cleaning.

Said cleaning may be carried out by way of wet cleaning (washing) and/or dry cleaning (roasting at a low temperature/drying). The number of cleaning cycles depends on the amount and type of lubricant contained in a particular batch of raw materials. If there is a large amount of lubricant or any other liquid or moisture, a centrifuge may be used to remove it prior to washing and/or drying. The number of washing cycles depends on the amount of oil-based lubricant. Washing is carried out with the addition of a washing agent (coagulant), which helps to remove any contamination. This process usually requires the use of heated water. Dry heating of the washed raw materials is carried out at low temperatures that do not exceed the ignition/burning point of the lubricant (below 200° C.). Said heating is carried out until the lubricant has evaporated.

Said cleaning of raw materials, where necessary, may also be applied to other components used in the claimed method for the production of a small-fraction titanium-containing filling for a cored wire.

All components used in the claimed method are in the form of particles each with a maximum size of 2 mm, which can be achieved by sieving and separating the appropriate material fraction.

The above-described raw material cleaning process may be applied both before and after the sieving, depending on the degree of contamination of the material.

As already mentioned above, according to the claimed method, as the basic titanium-containing component there may be used raw materials cleaned of impurities having a general chemical composition that comprises Ti content ranging from 50% to 99% inclusive, and impurities. Said impurities may comprise Al not to exceed 50%, V not to exceed 10%, C not to exceed 1%, Si not to exceed 1%, P not to exceed 1%, S not to exceed 1%, N2 not to exceed 1%, O2 not to exceed 3%, Bi not to exceed 1%, Pb not to exceed 1%, Mn not to exceed 1%, Sn not to exceed 2%.

However, based on the inventor's research and the analysis of the content of chemical elements in titanium-based alloy production waste and product scrap of all known grades (cleaned of impurities), the world's most common raw materials of that kind have a general chemical composition that comprises a Ti content of at least 82%, and impurities. Said impurities may comprise Al not to exceed 6%, V not to exceed 4%, C not to exceed 0.2%, Si not to exceed 0.25%, P not to exceed 0.01%, S not to exceed 0.01%, N2 not to exceed 1%, O2 not to exceed 3%, Bi not to exceed 0.004%, Pb not to exceed 0.001%, Mn not to exceed 0.04%, Sn not to exceed 0.35%, or other chemical elements.

The most titanium-rich raw materials (cleaned of impurities) have a general chemical composition that comprises a Ti content of 99%, and impurities. Said impurities may comprise Al not to exceed 1%, V not to exceed 1%, C not to exceed 0.2%, Si not to exceed 1%, P not to exceed 0.01%, S not to exceed 0.01%, N2 not to exceed 1%, O2 not to exceed 3%, Bi not to exceed 0.004%, Pb not to exceed 0.001%, Mn not to exceed 0.04%, Sn not to exceed 0.35%, or other chemical elements.

All said harmful impurities may or may not be present, and if any, their content must not exceed said limits.

When carrying out the claimed method for the production of a small-fraction titanium-containing filling for a cored wire, the general chemical composition of each of the components described above is measured using any known method. Thereafter, taking into account the obtained data on the general chemical composition of each component, said components are mixed in such a proportion that the resulting blend has a general chemical composition that comprises a Ti content in a range of 68% to 72% inclusive, and content of impurities.

The content of said impurities must not comprise Al exceeding 5%, V exceeding 3%, C exceeding 0.3%, Si exceeding 0.5%, P exceeding 0.04%, S exceeding 0.04%, N2 exceeding 0.5%, O2 exceeding 2%, Bi exceeding 0.01%, Pb exceeding 0.03%, Mn exceeding 1%, Sn exceeding 1.5%.

Said components may be mixed either manually (with a shovel in a container) or using any available mechanical means at a low speed with a continuous supply of any inert gas into the hopper, in order to remove oxygen and prevent ignition.

To preserve the homogeneity of the blend obtained as a result of the mixing, it is packed by portions with a weight not to exceed one metric ton. Packaging may be carried out in synthetic bags, which are placed in hermetic steel barrels and sealed under an argon layer to remove oxygen.

As seen from the above, the described method for the production of a small-fraction titanium-containing filling for a cored wire is configured to obtain a blend that has the same chemical composition as small-fraction ferrotitanium, which is used as a filling for a cored wire for the purpose of deoxidation and/or alloying of steel. Said blend may be used as a substitute for the above-mentioned small-fraction ferrotitanium. Moreover, the claimed method for the production of said blend is configured to avoid the use of metallurgical processing and high temperatures in the production process. In contrast to the production of small-fraction ferrotitanium, the claimed method does not involve the use in the production process of a metallurgical furnace, and heating of raw materials to the melting temperature or another high temperature close to the melting temperature, and it ensures a significant reduction in energy consumption along with cheaper production of the product, while significantly reducing the negative impact on the environment, and eliminating health and safety risks inherent in metallurgical production.

The invention claimed is:

1. A method for the production of a small-fraction titanium-containing filling for a cored wire, comprising a use of at least one titanium-containing component and at least one iron-containing component, wherein an iron-containing diluting component or an iron-containing diluting component together with a titanium-containing enriching component is added to a basic titanium-containing component, said components are mixed to achieve a homogeneous blend, said mixing of said components is carried out, based on a general chemical composition of each component, in a proportion that enables a resulting general chemical composition of the blend to comprise:

Ti content within a range of 68% to 72% inclusive, and

Fe content and at least one of the following impurities: Al not to exceed 5%, V not to exceed 3%, C not to exceed 0.3%, Si not to exceed 0.5%, P not to exceed 0.04%, S not to exceed 0.04%, N2 not to exceed 0.5%, O2 not to exceed 2%, Bi not to exceed 0.01%, Pb not to exceed 0.03%, Mn not to exceed 1%, Sn not to exceed 1.5%, or another impurity, said basic titanium-containing component is production waste or product scrap from titanium-based alloys or any combination thereof having a general chemical composition that comprises:

Ti content ranging from 50% to 99% inclusive, and at least one of the following impurities: Al not to exceed 50%, V not to exceed 10%, C not to exceed 1%, Si not to exceed 1%, P not to exceed 1%, S not to exceed 1%, N2 not to exceed 1%, O2 not to exceed 3%, Bi not to exceed 1%, Pb not to exceed 1%, Mn not to exceed 1%, Sn not to exceed 2%, or another impurity, said iron-containing diluting component is production waste or product scrap or products from iron-based alloys or any combination thereof having a general chemical composition that comprises:

predominant content of Fe, and at least one of the following impurities: Al not to exceed 1%, V not to exceed 1%, C not to exceed 0.2%, Si not to exceed 1%, P not to exceed 1%, S not to exceed 1%, N2 not to exceed 1%, O2 not to exceed 1%, Bi not to exceed 1%, Pb not to exceed 1%, Mn not to exceed 1%, Sn not to exceed 1%, or another impurity, said titanium-containing enriching component is titanium sponge or titanium 3D printing powder or titanium 3D printing powder waste or technically pure production waste or product scrap from titanium-based alloy products with high content of titanium or any combination thereof, said titanium sponge has a general chemical composition that comprises:

Ti content of at least 97%, and at least one of the following impurities: V not to exceed 1%, C not to exceed 0.1%, Si not to exceed 1%, P not to exceed 1%, S not to exceed 1%, N2 not to exceed 1%, 02 not to exceed 2%, Bi not to exceed 1%, Pb not to exceed 1%, Mn not to exceed 1%, or another impurity, said titanium 3D printing powder, or said titanium 3D printing powder waste have a general chemical composition that comprises:

Ti content of at least 97%, and at least one of the following impurities: C not to exceed 0.3%, P not to exceed 1%, S not to exceed 1%, N2 not to exceed 1%, 02 not to exceed 2%, Bi not to exceed 1%, Pb not to exceed 1%, Mn not to exceed 1%, or another impurity, said technically pure production waste or said product scrap from titanium-based alloy products with the high content of titanium or any combination thereof have a general chemical composition that comprises:

Ti content of at least 92%, and at least one of the following impurities: Al not to exceed 5%, V not to exceed 3%, C not to exceed 0.3%, Si not to exceed 0.5%, P not to exceed 0.04%, S not to exceed 0.04%, N2 not to exceed 0.5%, O2 not to exceed 2%, Bi not to exceed 0.01%, Pb not to exceed 0.03%, Mn not to exceed 1%, Sn not to exceed 1.5%, or another impurity, all of the above-mentioned components are used in a form of particles with a maximum size of 2 mm, said basic titanium-containing component is pre-washed, or dried, or pre-washed and dried before use.

2. The method for the production of a small-fraction titanium-containing filling for a cored wire according to claim 1, wherein said basic titanium-containing component is production waste or product scrap from titanium-based alloys or any combination thereof having a general chemical composition that comprises:

Ti content of at least 82%, and at least one of the following impurities: Al not to exceed 6%, V not to exceed 4%, C not to exceed 0.2%, Si not to exceed 0.25%, P not to exceed 0.01%, S not to exceed 0.01%, N2 not to exceed 1%, O2 not to exceed 3%, Bi not to exceed 0.004%, Pb not to exceed 0.001%, Mn not to exceed 0.04%, Sn not to exceed 0.35%, or another impurity.

3. The method for the production of a small-fraction titanium-containing filling for a cored wire according to claim 1, wherein said basic titanium-containing component is production waste or product scrap from titanium-based alloys or any combination thereof having a general chemical composition that comprises:

Ti content of at least 99%, and at least one of the following impurities: C not to exceed 0.2%, P not to exceed 0.01%, S not to exceed 0.01%, Bi not to exceed 0.004%, Pb not to exceed 0.001%, Mn not to exceed 0.04%, Sn not to exceed 0.35%, or another impurity.

4. The method for the production of a small-fraction titanium-containing filling for a cored wire according to claim 1, wherein all said components in a form of particles are obtained by sieving.

5. The method for the production of a small-fraction titanium- filling for a cored wire according to claim 1, wherein the iron-containing diluting component is the production waste or the product scrap or products from iron-based alloys in a form of swarf or grit or turnings or cuttings or fragments or granules or any combination thereof.

6. The method for the production of a small-fraction titanium-containing filling for a cored wire according to claim 1, wherein the titanium-containing enriching component is the technically pure production waste or the product scrap from the titanium-based alloys with the high content of titanium in a form of swarf or grit or turnings or cuttings or fragments or any combination thereof.

* * * * *